US007824246B2

(12) United States Patent
Inagaki et al.

(10) Patent No.: US 7,824,246 B2
(45) Date of Patent: Nov. 2, 2010

(54) WHEEL SPINDLE DEVICE FOR GRINDING MACHINE

(75) Inventors: Tomohiro Inagaki, Anjo (JP); Tomoyasu Imai, Kariya (JP); Takayuki Moroto, Okazaki (JP); Shinji Soma, Handa (JP)

(73) Assignees: Toyoda Van Moppes Ltd., Okazaki-shi (JP); JTEKT Corporation, Osaka-shi (JP)

( * ) Notice: Subject to any disclaimer, the term of this patent is extended or adjusted under 35 U.S.C. 154(b) by 162 days.

(21) Appl. No.: 12/131,593

(22) Filed: Jun. 2, 2008

(65) Prior Publication Data

US 2008/0305726 A1 Dec. 11, 2008

(30) Foreign Application Priority Data

Jun. 7, 2007 (JP) ..... 2007-151981

(51) Int. Cl.
*B24B 49/00* (2006.01)

(52) U.S. Cl. ..... 451/9; 451/246; 451/541; 451/547

(58) Field of Classification Search ..... 451/9, 451/10, 11, 242, 246, 251, 541, 547
See application file for complete search history.

(56) References Cited

U.S. PATENT DOCUMENTS

| | | | | |
|---|---|---|---|---|
| 4,439,951 | A * | 4/1984 | Oppelt et al. | 451/194 |
| 4,617,761 | A * | 10/1986 | Miyatake et al. | 451/219 |
| 5,611,724 | A | 3/1997 | deGraaff | |
| 6,019,666 | A | 2/2000 | Roberts et al. | |
| 6,267,647 | B1 * | 7/2001 | Stocker et al. | 451/44 |

FOREIGN PATENT DOCUMENTS

| | | |
|---|---|---|
| EP | 1 174 400 A1 | 1/2002 |
| GB | 2 309 184 A | 7/1997 |
| JP | 51-61578 | 5/1976 |
| JP | 61-257777 | 11/1986 |
| JP | 62-278207 | 12/1987 |
| JP | 1-125167 | 8/1989 |
| JP | 2000-176828 | 6/2000 |
| JP | 2000-354969 | 12/2000 |
| JP | 2002-18728 | 1/2002 |
| JP | 2002-66931 | 3/2002 |
| JP | 2003-39334 | 2/2003 |
| JP | 2003-300165 | 10/2003 |
| JP | 2006-68856 | 3/2006 |
| JP | 2006-88291 | 4/2006 |

* cited by examiner

*Primary Examiner*—Eileen P. Morgan
(74) *Attorney, Agent, or Firm*—Oblon, Spivak, McClelland, Maier & Neustadt, L.L.P.

(57) ABSTRACT

In a wheel spindle device wherein a plurality of grinding wheels are attached in a juxtaposed relation to a wheel spindle rotatably carried on a wheel head of a grinding machine, a reference position for specifying a position in the circumferential direction of the grinding wheel is provided on a core member of each of the grinding wheels, and a plurality of inclined grooves at predetermined angular intervals are formed on a grinding surface of each grinding wheel to be inclined relative to the circumferential direction of each grinding wheel. In order that the fluctuations in the dynamic pressure and the grinding resistance between respective grinding wheels and workpiece portions ground therewith do not grow as a combined or synergy effect, the inclined grooves on each grinding wheel are shifted in angular phase from those on another grinding wheel, so that grinding efficiency and accuracy can be enhanced.

6 Claims, 6 Drawing Sheets

WHEEL SPINDLE DEVICE FOR GRINDING MACHINE

INCORPORATION BY REFERENCE

This application is based on and claims priority under 35 U.S.C. 119 with respect to Japanese patent application No. 2007-151981 filed on Jun. 7, 2007, the entire content of which is incorporated herein by reference.

BACKGROUND OF THE INVENTION

1. Field of the Invention

The present invention relates to a wheel spindle device for mounting a plurality of grinding wheels with inclined grooves formed on grinding surfaces thereof, on a wheel spindle of a grinding machine.

2. Discussion of the Related Art

In Japanese unexamined, published patent application No. 2000-354969, there is described a grooved grinding wheel, wherein an abrasive grain layer including super abrasive grains such as, for example, diamond or cubic boron nitride (CBN) is formed on a circumferential surface of a disc-like core member drivingly rotated about an axis. Oblique or inclined grooves each having a predetermined width and a predetermined depth are formed on a grinding surface which is a circumferential surface of the abrasive grain layer, at an angle inclined in a range of 25 to 45 degrees relative to the axis of the core member. The grooved grinding wheel like this is capable of effectively leading coolant along the inclined grooves to a grinding point and hence, is capable of enhancing the grinding efficiency as a result of increasing the material removable rate to about one and half times as high as that of a grinding wheel which does not have such inclined grooves.

Further, it is generally known in the art that coolant supplied to a grinding point causes a dynamic pressure to be generated between a grinding wheel and a workpiece being ground therewith. Therefore, it is necessary to prevent the machining accuracy and the machining efficiency from being deteriorated as a result that the dynamic pressure causes the workpiece to be displaced away from the grinding wheel.

Further, Japanese unexamined, published patent application No. 2006-068856 describes a wheel spindle structure, wherein two grinding wheels are secured in a juxtaposed relation by means of a plurality of bolts with a predetermined space retained therebetween and are mounted on a wheel spindle of a wheel head. In the construction shown in the patent document, the wheel spindle is rotatably supported at opposite end portions thereof. This way of supporting the wheel spindle decreases the bending or flexing of the wheel spindle during a machining operation, so that the machining accuracy can be enhanced. In addition, the way of supporting the wheel spindle makes it possible to separate the wheel spindle in the axial direction, so that the exchange of the grinding wheels with those fresh becomes easy. Generally, the production efficiency can be improved by the use of plural grinding wheels, because it becomes possible to grind two axially spaced portions of the workpiece to the same or different shapes at a time.

However, in the prior art device described in the first mentioned Japanese application, it occurs that the number of the inclined grooves which across the grinding point area changes from one groove to two grooves and vice versa. This undesirably causes the area on the grinding surface (i.e., the area of abrasive grains of the grinding wheel which contacts the workpiece) to vary in dependence on the positions of the inclined grooves or the rotational angle of the grinding wheel, whereby change occurs in the grinding resistance. Further, it may be the case that it is difficult as practical matter to make the inclined grooves uniform in width. The lack of uniformity in the inclined grooves formed on the grinding surface likewise causes the grinding resistance to fluctuate.

In particular, where several grinding wheels each with such inclined grooves formed on the grinding surface thereof are assembled on a wheel spindle 32 in axial alignment as shown in FIG. 11, the following drawback may arise. That is, where the angular phases of the inclined grooves 20 formed on one grinding wheel 10 are in coincidence with those on the other or another grinding wheel 10, the grinding resistances on the respective grinding wheels may be synchronized to grow through a combined or synergy effect therebetween. This may undesirably results in chattering as the case may be, and may give rise to a drawback that the machining accuracy of the workpiece is deteriorated.

SUMMARY OF THE INVENTION

It is therefore a primary object of the present invention to provide an improved assembling structure that a plurality of grinding wheels each with inclined grooves formed on a grinding surface thereof are mounted on a wheel spindle and that is capable of enhancing production efficiency without increasing the fluctuations in the grinding resistances between a workpiece and respective grinding wheels and also capable of enhancing the machining accuracy.

Briefly, according to the present invention, there is provided a wheel spindle device for a grinding machine, which comprises a wheel head of the grinding machine, a wheel spindle rotatably supported on the wheel head, and a plurality of grinding wheels attached to the wheel spindle and each composed of a core member attached to the wheel spindle and a grinding layer provided on the circumferential surface of the core member and having numerous abrasive grains bonded with a bonding material. A reference position for specifying a position in the circumferential direction is defined on each of the core members. A plurality of inclined grooves which are inclined relative to the circumferential direction of each grinding wheel are formed on the circumferential surface of the grinding layer at predetermined angular intervals on the basis of the reference position, and the inclined grooves formed on the grinding layer of each grinding wheel are shifted in angular phase from the inclined grooves formed on the grinding layer of another grinding wheel.

Where inclined grooves are formed on a grinding surface of a grinding wheel, a grinding resistance between the grinding wheel and a workpiece ground therewith fluctuates at respective time points with a variation in the number of the inclined grooves passing across a grinding point as well as in a tiny or slight change in shape of the inclined grooves. With the aforementioned construction of the invention, however, since the inclined grooves formed on one grinding wheel and those formed on another grinding wheel are shifted through different angular distances relative to the reference position defined on the core member of each grinding wheel not to coincide between the grinding wheels, the fluctuations in the grinding resistances on the respective grinding wheels can be mitigated not to grow as a combined or synergy effect through synchronization between the grinding wheels. As a consequence, the fluctuation in the grinding resistance is reduced in the direction normal to the grinding surface, so that it can be realized to enhance the machining accuracy of the workpiece.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

First Embodiment

Figure 1:
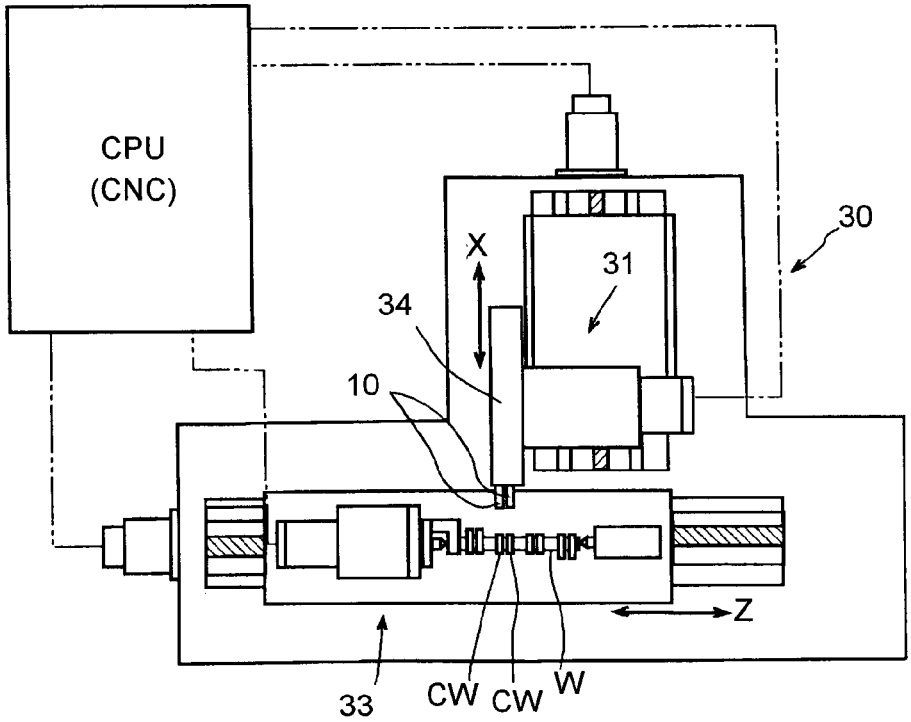
FIG. 1 is a schematic plan view of a grinding machine incorporating a wheel spindle device in a first embodiment according to the present invention.

Hereafter, a wheel spindle device for a grinding machine in a first embodiment according to the present invention will be described with reference to the accompanying drawings. Referring now to FIG. 1, there is shown a cylindrical grinding machine 30, wherein a camshaft W of a so-called "twin-cam type" as workpiece is rotatably supported by a workpiece support device 33 which comprises a work head and a foot stock (both not numbered). Two grinding wheels 10 referred to later in detail which are assembled to a wheel spindle 32 (FIG. 2) of a wheel head 31 are covered with a wheel cover device 34, to which a coolant nozzle (not shown) is attached. Coolant is supplied from the coolant nozzle toward a grinding point between the grinding wheel 10 and the workpiece W. When the wheel head 31 is advanced, grinding surfaces 15 (FIG. 2) which are formed as circumferential surfaces of abrasive grain layers 12 (FIG. 5) of the two grinding wheels 10 are brought into contact respectively with paired cam sections CW at the grinding point, so that circumferential surfaces of the cam sections CW can be ground simultaneously. Herein, the term "grinding point" means a contact point between each grinding wheel and a ground portion of a workpiece as conventionally used in the grinding field and has a width corresponding to the width of the ground portion of the workpiece where the ground portion is a generally cylindrical portion including a cam.

Figure 2:
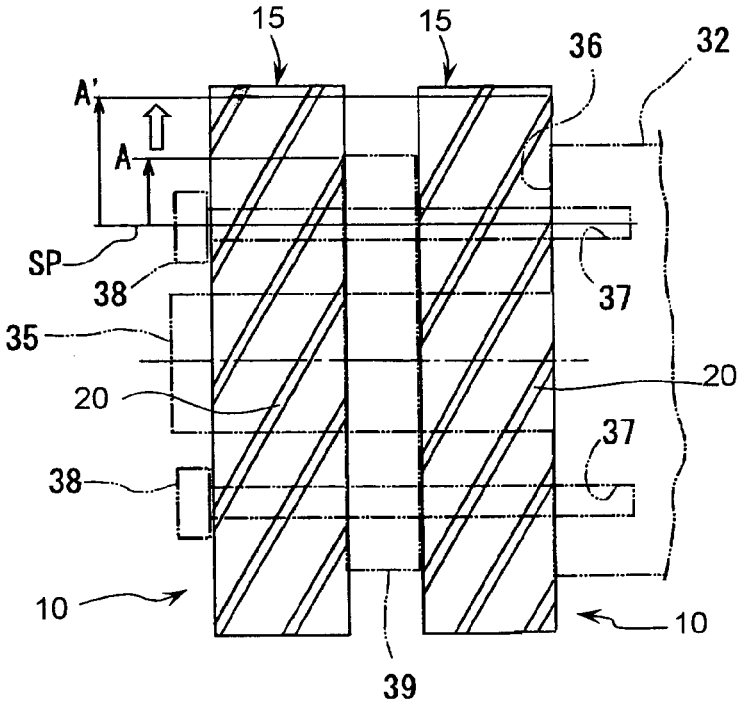
FIG. 2 is a fragmentary view of the wheel spindle device wherein two grinding wheels are attached to a wheel spindle with the angular phases of their inclined grooves being shift in the rotational direction.

As shown in FIG. 2, the grinding wheels 10 are attached in a juxtaposed relation to the wheel spindle 32 which is supported on the wheel head 31 of the grinding machine 30 to be rotatable about the axis thereof. The wheel spindle 32 has formed at one end thereof a slender protruding portion 35 and an assembling end surface 36 on which a plurality of screw holes 37 are formed on a bolt circle about the axis of the wheel spindle 32 at equiangular distances. Between the two grinding wheels 10, a spacer ring 39 is provided having a plurality of through holes which correspond to the screw holes 37 in bolt circle as well as angular phase. The two grinding wheels 10 also have a plurality of though holes which can be in alignment respectively to the screw holes 37. The two grinding wheels 10 are assembled to the assembling end surface 36 by means of bolts 38 with the spacer ring 39 being interposed therebetween. Each of the two grinding wheels 10 on the right and left sides has a plurality of oblique or inclined grooves 20 formed at the circumferential surfaces 15 thereof at equiangular intervals. The inclined grooves 20 on the left grinding wheel 10 and the inclined grooves 20 on the right grinding wheel 10 are set on the basis of a predetermined one (hereafter referred to as "specified bolt hole") of the bolt holes (bolts 38) as a reference position SP and are offset or shifted in angular phase through different angular distances. Thus, when these two grinding wheels 10 are assembled to the wheel spindle 32, as viewed in FIG. 2, the position of a point (A) which is in alignment with one end of each inclined groove 20 formed on the grinding wheel 10 on the left side and the position of a corresponding point (A') which is in alignment with a corresponding one end of each inclined groove 20 formed on the grinding wheel 10 on the right side are shifted through different angular distances with respect to the reference position SP. The wheel spindle device is constituted by the two grinding wheels 10, the wheel spindle 32 and the specified bolt hole (specified bolt 38) as the reference position SP.

Figure 3:
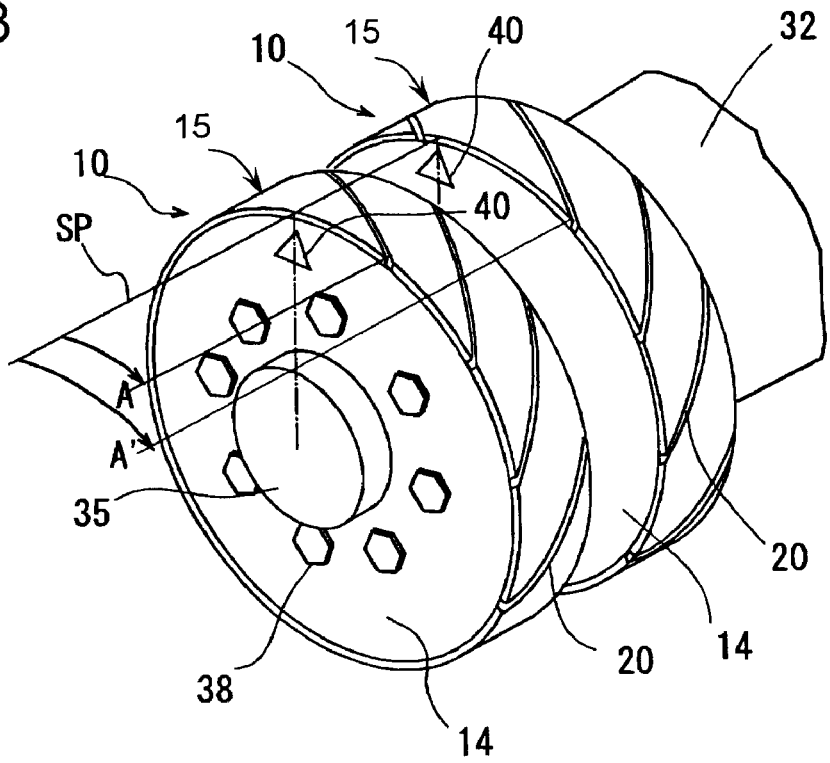
FIG. 3 is a perspective view of a wheel spindle device in a modified form wherein an up mark specifying a reference position is put as another example on a core member of each of two grinding wheels.

In a modified form of the present or first embodiment, an attaching indicator (an up mark) 40 shown in FIG. 3 is used as another example of the reference position SP. The attaching indicator 40 indicates a reference position for attaching each of respective grinding wheels 10 to a truing device (not shown) outside the grinding machine 30 and a balancing machine (not shown), which are provided independently of the grinding machine 30, and also to the wheel spindle device in the same angular position. Prior to an initial wheel truing operation and a wheel balancing adjustment subsequent thereto, the attaching indicator 40 is put on each of the respective grinding wheels 10. In this case, the angular distance (A) from the attaching indicator 40 to one inclined groove 20 (an end of one inclined groove 20) on the left grinding wheel 10 is made to differ from the angular distance (A') from the attaching indicator 40 to one inclined groove 20 (an end of one inclined groove 20) on the right grinding wheel 10, as shown in FIG. 3. After the attaching indicators 40 are put on the respective grinding wheels 10, the initial wheel truing operation and the wheel balancing adjustment will be carried out as described hereinafter.

Figure 4:
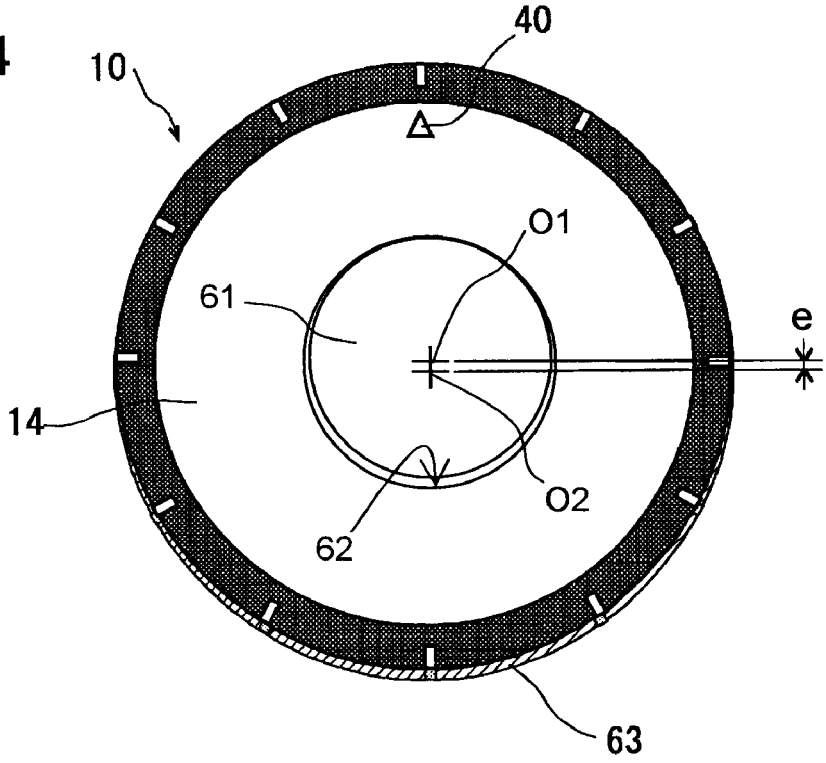
FIG. 4 is an explanatory view for explaining the way of attaching a grinding wheel to a truing spindle of a truing device which is provided independently of the grinding machine.

First of all, the grinding wheels 10 are selectively attached to the truing device outside the grinding machine 30 for the initial truing operation. In attaching each grinding wheel 10 to the truing device, an attaching hole 62 of the grinding wheel 10 is fitted on a truing spindle 61 of the truing device, with the attaching indicator 40 takes the top position on a rotational locus thereof as shown in FIG. 4. At this time, due to a clearance between the attaching hole 62 and the truing spindle 61 and due to the gravity of the grinding wheel 10, the grinding wheel 10 is fitted on the truing spindle 61 to make the axis O2 of the grinding wheel 10 eccentric downward from the axis O1 of the truing spindle 61 by an eccentricity (e). In this state, the grinding wheel 10 is attached to the truing spindle 61 of the truing device in the same manner as it is attached to the wheel spindle 32 of the wheel head 31 in the grinding machine 30. As known in the art, the truing device (not shown) outside the grinding machine 30 is composed of a spindle head unit of the construction similar to the wheel head 31 and a truing unit for truing the grinding wheel 10 rotating together with the truing spindle 61 of the spindle head unit by moving a truing tool to traverse the grinding surface 15 of the grinding wheel 10 in a direction parallel to the axis of the truing spindle 61. The truing tool may be a rotary disc-like truing roll whose width is narrower than the width of the grinding wheel 10 to be trued, or may be a non-rotatable point diamond truer. In another form, there may be used a rotary truing roll whose width is wider than the width of the grinding wheel 10 to be trued, wherein the rotary truing roll is plunge-feed against the grinding wheel 10. In this way, one grinding wheel 10 is trued to remove a hatched, crescent-portion 63 shown in FIG. 4 and is shaped to a true circle about the axis of the truing spindle 61, whereby a shape unbalance of the grinding wheel 10 is corrected. The initial truing operation can be judged to have been completed when a truing sound generated by the contact of the truing tool with the rotating grinding wheel 10 changes from an intermittent sound to a continuous one. The shape correction on the other grinding wheels 10 is then performed in the same manner as described above.

Then, fine balancing adjustments are performed on the grinding wheels 10. That is, each grinding wheel 10 unattached from the truing device is subjected to a fine balancing adjustment on the balancing machine (not shown) which is well-known in the art. For fine balancing adjustment, each grinding wheel 10 is attached to a balancing spindle (not shown) of the balancing machine in the same manner as it is attached to the truing spindle 61 of the truing device and the wheel spindle 32 of the wheel head 31 in the grinding machine 30. Specifically, the attaching hole 62 of the grinding wheel 10 is fitted on the balancing spindle of the balancing machine, with the attaching indicator 40 being positioned at the top position on a rotational locus thereof in the same manner as shown in FIG. 4. Then, the balancing machine is operated, and the grinding wheel 10 is rotated at a high speed to measure an unbalancing point on the grinding wheel 10. After the measuring of the unbalancing point, the rotation of the balancing spindle is stopped, and gravity balance is adjusted by cutting a portion of the core member 14 which corresponds in angular phase to the unbalancing point. This cutting can be done using any suitable tool such as, a hand drill, a file or the like. After this, the measuring and removable of another unbalancing point is repeated if need be.

After the aforementioned shape unbalance and the aforementioned gravity unbalance of each grinding wheel 10 are corrected in the manner as described above, the grinding wheels 10 so balanced are attached to the wheel spindle 32 of the wheel head 31 in the grinding machine 30 one after another, with each of their attaching indicators (the up marks) 40 being positioned at the top position on the rotational locus thereof. As a consequence, the grinding wheels 10 can be used in the state that the center or axis of the grinding surface 15 and the gravity center of each grinding wheel 10 is accurately in coincidence with the axis of the wheel spindle 32, so that it can be realized to prevent vibration from being generated during the high speed rotation thereof.

Figure 5:
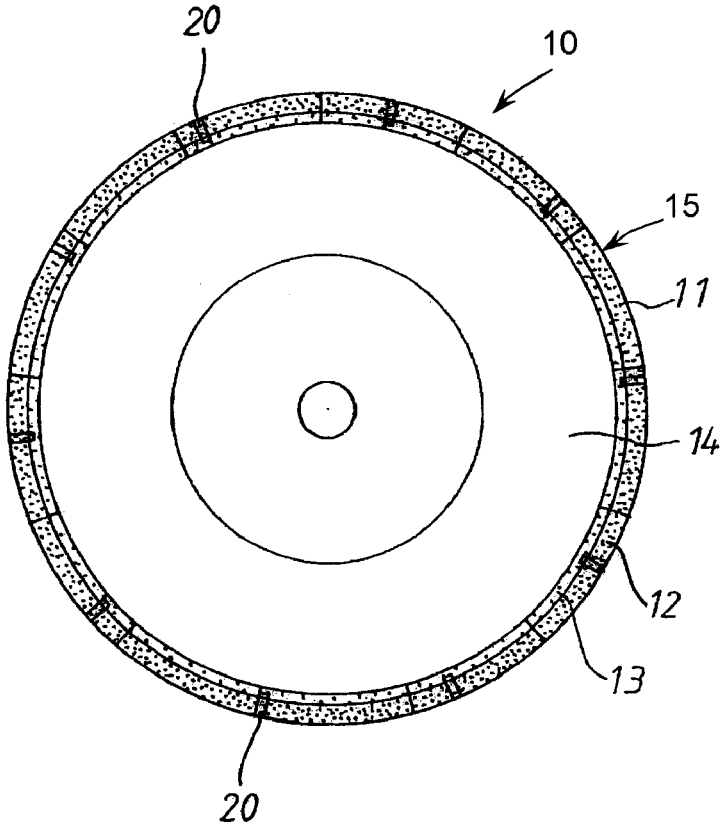
FIG. 5 is a side view of a grinding wheel with segment wheel chips attached thereto.

Next, the construction of the grinding wheels 10 will be described. FIG. 5 shows the construction of each grinding wheel 10 provided with a plurality of segment wheel chips 11 attached thereto. In each of the wheel chips 11, a abrasive grain layer 12 which is made by bonding super abrasive grains with a vitrified bond is formed on a radial outside, and a foundation layer 13 not including the super abrasive grains are integrally formed on an inner side of the abrasive grain layer 12 to be piled up thereon. Each grinding wheel 10 takes the construction that a plurality of arc-shaped wheel chips 11 each composed of the abrasive grain layer 12 and the foundation layer 13 are arranged on the circumferential surface of the disc-like core member 14 which is made of a metal such as, e.g., iron or aluminum, fiber-reinforced resin, or the like, and are adhered with an adhesive at bottom surfaces of the foundation layers 13 to the core member 14.

Figure 6:
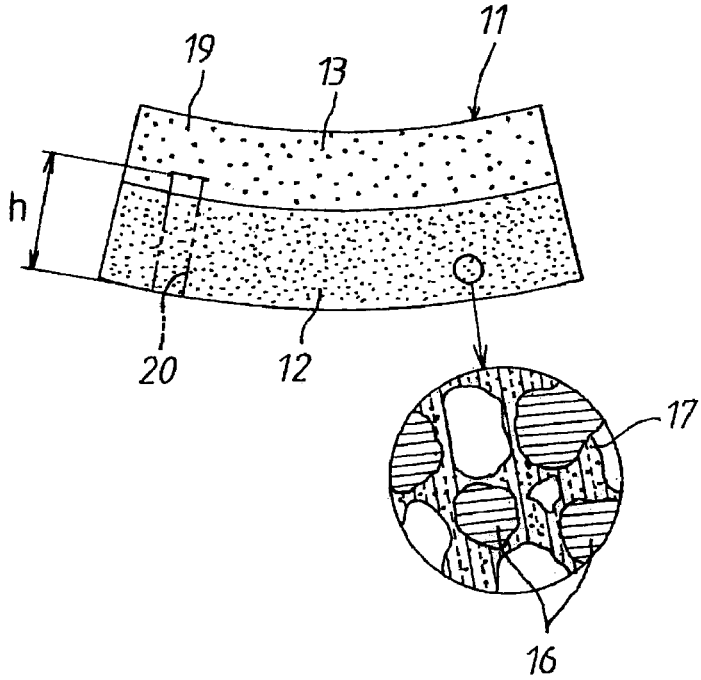
FIG. 6 is an enlarged side view of a wheel chip.

FIG. 6 shows the construction of each arc-shaped wheel chip 11. The abrasive grain layer 12 contains the super abrasive grains 16 such as, e.g., CBN, diamond or the like bonded with vitrified bond 17 to the thickness of 3 to 5 millimeters. If need be, particles made of aluminum oxide ($Al_2O_3$) or the like may be mixed in the wheel chip 11 as aggregate replacing some super abrasive grains for adjustment of concentration. The foundation layer 13 is constituted by bonding foundation particles 19 with vitrified bond to the depth of 1 to 3 millimeters. Where the vitrified bond 17 is employed as bonding material numerous pores are formed in the wheel chip 11. This enhances the ability of the wheel chip 11 (hence, of the grinding wheel 10) to discharge grinding chips and makes the grinding quality of the grinding wheel 10 sharp, so that the grinding wheel can grind a workpiece to have a fine surface roughness with little quantity of wear or abrasion. Besides the vitrified bond 17, any other bonding material such as resinoid bond, metal bond or the like may be used as the bonding agent. Further, each wheel chip 11 has inclined grooves 20 formed as depression grooves to a depth (h) from the surface of the abrasive grain layer 12.

Figure 7:
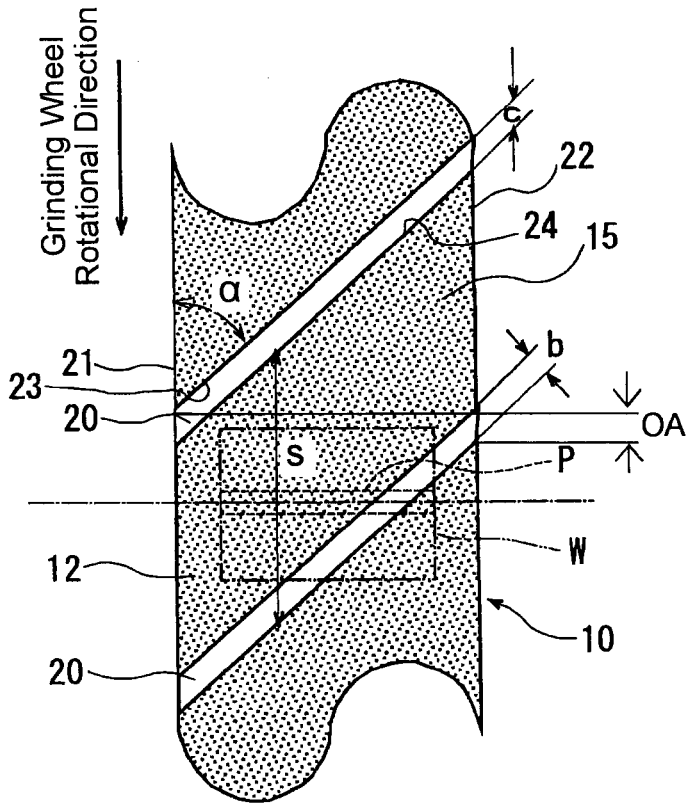
FIG. 7 is an explanatory view showing the relation between the width in the circumferential direction and the inclination angle of each inclined groove.

As shown in FIG. 7, the plurality of inclined grooves 20 each inclined relative to the wheel circumferential direction and each having a width (b) are formed as depression grooves on the grinding surface 15 of each grinding wheel 10 at regular or equiangular intervals. The arrangement of the inclined grooves 20 are such that at least one inclined groove 20 passes across the grinding point P in the vertical direction even in any rotational phase of the grinding wheel 10. That is, each of the inclined grooves 20 formed on each grinding wheel 10 has an overlapping angular area (OA) in which it partly aligns or overlaps in the axial direction of the grinding wheel 10 with another inclined groove 20 which is formed next thereto in the rotational direction, and thus, respective portions of at least two inclined grooves 20 extend in parallel relation in the overlapping angular area (OA). By widening the overlapping angular area (OA), it becomes possible that two or more inclined grooves 20 formed on each grinding wheel 10 continually pass across the grinding point P in the vertically direction during the grinding operation, as referred to later.

Each inclined groove 20 extends over opposite end surfaces 21 and 22 of the abrasive grain layer 12 which are parallel to the circumferential direction of the grinding wheel 10. An acute angle ($\alpha$) is made between one end surface 21 and one of groove wall surfaces 23 of each groove 20 as well as between the other end surface 22 and the other groove wall surface 24 of each groove 20. The inclined grooves 20 formed on one grinding wheel 10 on the left side are the same as the inclined grooves 20 formed on the other grinding wheel 10 on right side in any of inclination angle (α), angular interval (s) and in shapes (b, h). Preferably, the inclined grooves 20 formed on one grinding wheel 10 are angularly offset from the inclined grooves 20 formed on the other grinding wheel 10 by about the half of the angular interval (s) between the inclined grooves 20.

Since at least one of the inclined grooves 20 continually passes across the grinding point P as apparent in FIG. 7, coolant supplied to the grinding point P is relieved of generating a dynamic pressure. This advantageously prevents the workpiece (camshaft) W from being displaced away from the grinding wheel 10 during a grinding operation and hence, from being undesirably increased to an unintended dimension or diameter. As a consequence, the grinding accuracy can be enhanced particularly in roundness.

As aforementioned, the inclined grooves 20 are effective in preventing the generation of a dynamic pressure in the coolant supplied to the grinding point P, and the requirements in forming the inclined grooves 20 are determined through experiments or the like as follows. First, the arrangement of the inclined grooves 20 on the grinding surface 15 should be such that at least one inclined groove 20 or, preferably, two or more inclined grooves 20 pass across the grinding point P in the vertical direction within the axial length of the grinding point P even in any rotational phase of the grinding wheel 10. The provision of each inclined groove 20 makes long a circumferential grain-to-grain interval which each abrasive grain protruding from the grinding surface 15 on one edge side of each inclined groove 20 makes relative to an abrasive grain protruding from the grinding surface 15 on the other edge side in the wheel circumferential direction. Therefore, a circumferential groove width (c) which is the width of each inclined groove 20 in the circumferential direction of the grinding wheel 10 should be narrow not to make the circumferential grain-to-grain interval too long. The number of the inclined grooves 20 should be small to reduce the manufacturing man-hours. The angular interval or groove-to-groove interval (s) which each inclined groove 20 makes relative to the next in the wheel circumferential direction should be long to avoid a drawback that a short groove-to-groove interval makes the manufacturing difficult and weakens the strength of the wheel chips 11. The total area of the inclined grooves 20 should not be so large in order to avoid drawbacks that a large total area decreases the number of the super abrasive grains 16 working for grinding operation and increases the wear or abrasion quantity of the grinding wheel 10.

Hereinafter, description will be made regarding the method of determining an appropriate number (n) of the inclined grooves 20 and an appropriate inclination angle (α) with these requirements taken into consideration for use, e.g., in grinding a workpiece W having the width of 15 millimeters with a grinding wheel 10 of 350 millimeters in the outer diameter. The inclination angle (α) is an angle that each inclination groove 20 makes with the one end surface 21 of the abrasive grain layer 12, that is, with the wheel circumferential direction, and the axial length of the grinding point (P) is 15 millimeters which is the same as the width of the workpiece W.

The width (b) of each inclination groove 20 in the direction normal thereto should be 1 millimeter long or so with the strength of a groove-forming grinding wheel taken into consideration and for the purpose of shortening the circumferential groove width (c) which is the width of each inclined groove 20 in the circumferential direction of the grinding wheel 10. The relation between the groove circumferential width (c) and the inclination angle (α) of the inclined grooves 20 is such that the former becomes shorter as the latter increases. Where the inclination angle (α) is increased to 15 degrees or so, the groove circumferential width (c) can be shortened, so that the circumferential grain-to-grain interval of the grains opposed with each inclined groove 20 therebetween can be suppressed to a short length.

In this way, in the present embodiment, the specifications of the inclined grooves 20 are determined so that two inclined grooves 20 pass across the grinding point P in the vertical direction within the width of the workpiece W or the axial length of the grinding point P even in any rotational phase of the grinding wheel 10 where the workpiece W of 15 millimeter width is ground with the grinding wheel 10 of 350 millimeter in the outer diameter through a plunge feed. The specifications in one example so determined are 1 millimeter in the groove width (b), 7 millimeters in the groove depth (h), 15 degrees in the inclination angle (α) and 39 in the number of grooves.

Next, the method of manufacturing a grinding wheel with inclined grooves will be described. First of all, the wheel chips 11 are made in a well-known method and are adhered to the core member 14 to make a grinding wheel 10. As mentioned earlier, the specifications of the inclined grooves 20 are determined based on the outer diameter of the grinding wheel 10, the width of the workpiece W, the number of the inclined grooves 20 that continually pass across the grinding point P within the axial length of the grinding point P even in any rotational phase of the grinding wheel 10, and the like. In agreement with the specifications of the inclined grooves 20 so determined, the inclined grooves 20 are formed on the circumferential surface 15 of the grinding wheel 10 by machining using a groove-forming grinding wheel. In this case, the machining is performed to form the inclined grooves 20 on the circumferential surface 15 of the first grinding wheel 10 at respective angular positions each having a predetermined relation with respect to the reference position SP and to form the inclined grooves 20 on the circumferential surface 15 of the second grinding wheel 10 at respective angular positions which are different in phase from those positions on the first grinding wheel 10 with respect to the reference position SP. That is, the angular positions where the inclined grooves 20 are respectively formed on the grinding surface 15 of the first grinding wheel 10 are shifted by a predetermined angular phase from those corresponding where the inclined grooves 20 are formed on the grinding surface 15 of the second grinding wheel 10.

The inclined grooves 20 may be formed by press-forming. In this modified form, the inclined grooves 20 are press-formed on the wheel chips 11 prior to a burning process, and the wheel chips 11 with the inclined grooves 20 formed thereon are burned at the burning process. The adhesions of the wheel chips 11 on the core member 14 of the first grinding wheel 10 are initiated from a first angular position which has a predetermined positional relation relative to the reference position SP, and the adhesions of the wheel chips 11 on the core member 14 of the second grinding wheel 10 are initiated at a second angular position which differs from the first angular position relative to the reference position SP.

Next, the operation of the wheel spindle device as constructed above for a grinding machine will be described. The two grinding wheels 10 are drivingly rotated with themselves being attached at the core members 14 thereof to the wheel spindle 32 which is rotatably supported on the wheel head 31 of the grinding machine 30 shown in FIG. 1, while the workpiece (camshaft) W is drivingly rotated with itself being supported by the workpiece support device 33 composed of the work head and the foot stock. Coolant is supplied from the coolant nozzle (not shown) attached to the wheel cover device 34 toward the grinding point P between the grinding wheels 10 and the camshaft W. The wheel head 31 is advanced toward the camshaft W at the grinding feed rate which is changed stepwise, whereby the camshaft W is ground with the rotating grinding wheel 10. It is generally known that where the circumferential speed of a grinding wheel is set to 80 meters per second or higher, the dynamic pressure which is generated in the coolant supplied to the grinding point P increases sharply to deteriorate the machining accuracy. In the present embodiment, however, of the plurality of inclined grooves 20 extending inclined relative to the wheel circumferential direction, at least one inclined groove 20 continually passes across the grinding point P even in any rotational phase of the grinding wheel 10, and therefore, it is possible for the continually passing groove 20 to relieve the dynamic pressure which the coolant supplied to the grinding point P would otherwise generate between the grinding surface 15 and the camshaft W, by discharging the coolant therealong toward the upper and lower sides of the grinding point P. Thus, it becomes possible to perform an efficient grinding operation with the grinding wheel 10 rotating at the circumferential speed of 120 meters per second or so. In addition, since the camshaft W is prevented from being displaced away from the grinding wheel 10 due to the dynamic pressure, it does not occur that the cam section CW is ground to an unintended oversize, so that the grinding accuracy can be enhanced particularly in roundness.

Further, even in the grinding wheel 10 with the inclined grooves 20 formed thereon, it is likely that with the change in the number of the inclined grooves 20 passing across the grinding point P as well as with the tiny or slight change in the shape of each inclined grove 20, the dynamic pressure caused by coolant and the grinding resistance fluctuate at respective time points during the grinding operation. In particular, the fluctuations in the dynamic pressure and the grinding resistance are likely to be doubled where simultaneous grindings are performed with the several grinding wheels 20. In the present embodiment, however, the angular phases of the inclined grooves 20 on one grinding wheel 10 and the angular phases of those on the other grinding wheel 10 differ from each other with respect to the reference position SP not to coincide with each other. Thus, the fluctuations in the dynamic pressures and the grinding resistances on the respective grinding wheels 10 are mitigated not to grow as a combined or synergy effect through synchronization between the two grinding wheels 10. In particular, these effects are outstanding where the grinding wheels 10 are used at the circumferential speed of 80 meters per second or higher. As a consequence, the fluctuation in the grinding resistance is reduced in the direction normal to the grinding surface 15, so that it can be realized to enhance the machining accuracy of the workpiece W without bringing about chattering during the grinding operation.

Further, in the different form that the reference position SP is set as shown in FIGS. 3 and 4, as mentioned earlier, the two grinding wheels 10 are individually adjusted for respectively correct balances with their reference positions SP being set at respective angular phases different in angular phase from the respective inclined grooves 20, and the indicators 40 each indicating the position which was used as the basis for the balance adjustment of each grinding wheel 10 is put as the reference position SP on each of the grinding wheels 10. By doing so, it can be done easily to assemble the two grinding wheels 10 with the angular phases of the inclined grooves 20 on one grinding wheel 10 being shifted from those of the inclined grooves 20 on the other grinding wheel 10, and hence, the efficiency in the assembling work can be enhanced at a great rate. In addition to the advantage that it can be realized to reduce the vibration caused by the combined or synergy effect between the fluctuations in the dynamic pressure and the grinding resistance, the assembly of the two grinding wheels 10 can be reduced in vibration as a result of being assembled with reference to the attaching indicators 40, so that the machining accuracy and the productivity can be enhanced at a great rate.

Further, a rotation restriction member such as, for example, one of the bolt holes (or the bolts 38 screwed therein), a keyway which may be provided on each grinding wheel 10, or the like can be utilized as the reference position SP. In this case, the grinding wheels 10 can be attached to the wheel spindle 32 by the use of such existing features thereon without using the aforementioned specified mark, with the inclined grooves 20 on one grinding wheel 10 being offset in angular phase from those on the other grinding wheel 10.

Other Embodiments

In the foregoing embodiment, the inclined grooves 20 on the grinding wheels 10 are arranged to incline in the same direction. However, the present invention is not limited to such formation of the inclined grooves 20. In a second embodiment shown in FIG. 8, for example, the inclined grooves 20 on one grinding wheel 10 and those on the other grinding wheel 10 are inclined in opposite directions with the angular phases being shifted from each other therebetween. This advantageously ensures that the axial force generated by the inclined grooves 20 on one grinding wheel 10 in one axial direction can be cancelled with the axial force generated by the inclined grooves 20 on the other grinding wheel 10 in the other axial direction, so that the machining accuracy of the workpiece portions CW can be further enhanced.

Figure 9:
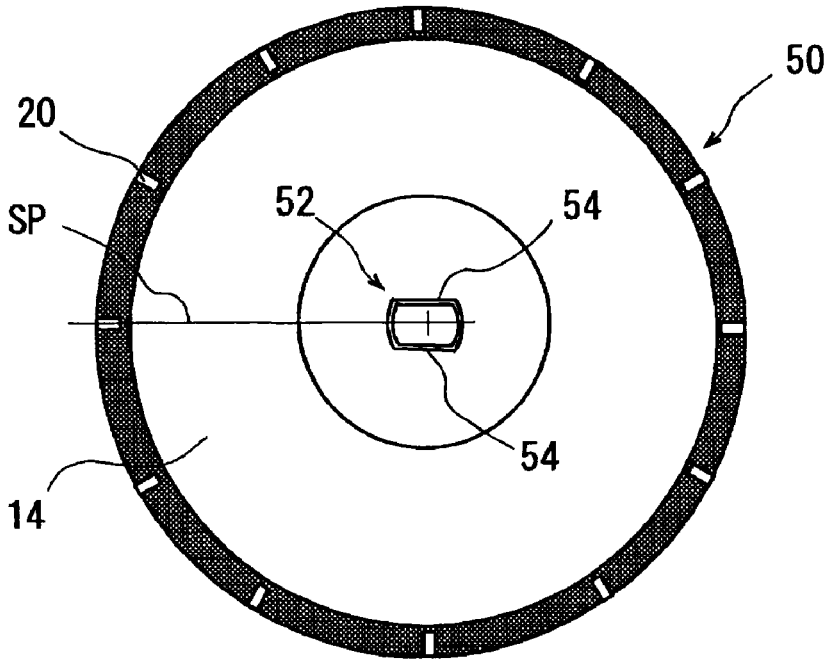
FIG. 9 is an explanatory view showing the angular phase relation between a reference position and inclined grooves on one grinding wheel in a third embodiment according to the present invention.
Figure 10:
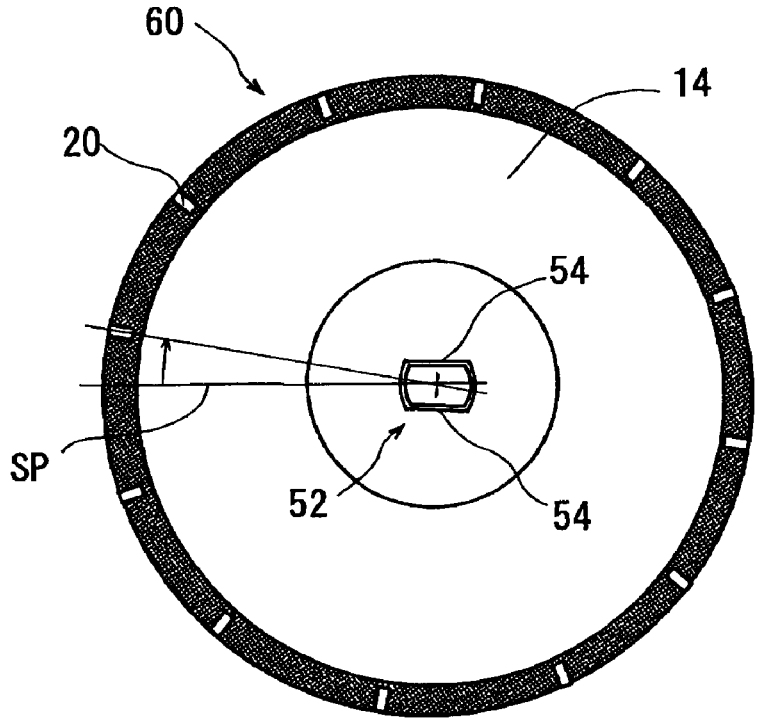
FIG. 10 is an explanatory view showing the angular phase relation between the reference position and inclined grooves on another or second grinding wheel in the third embodiment.
Figure 11:
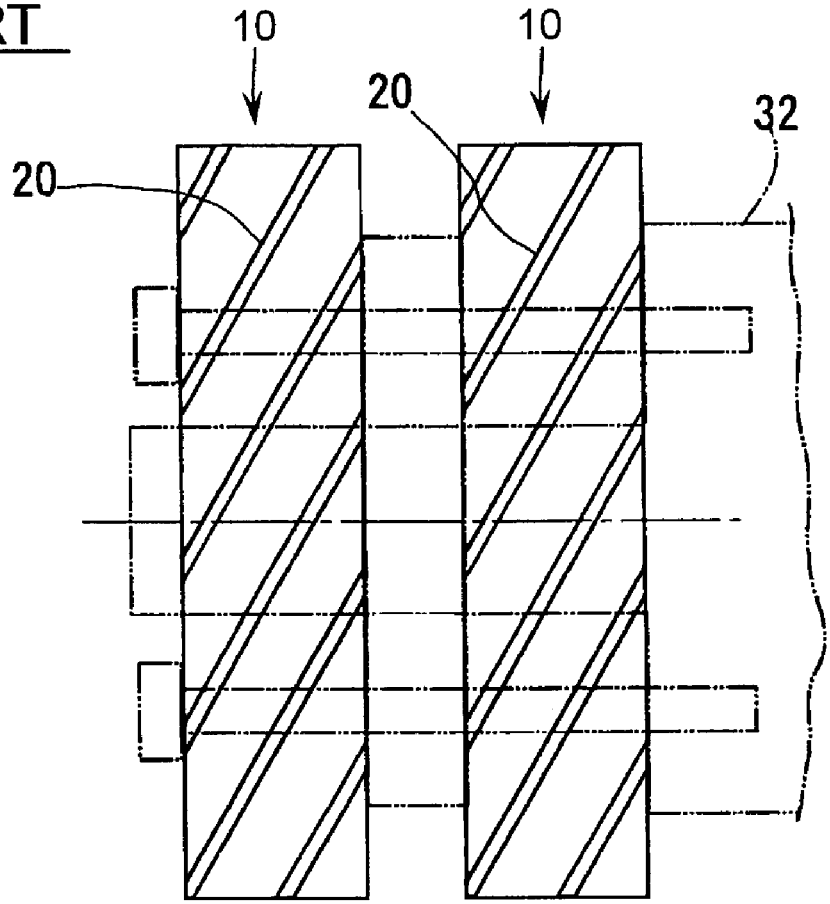
FIG. 11 PRIOR ART
FIG. 11 is a fragmentary view of a wheel spindle device in a prior art.

In addition, as shown in FIGS. 9 and 10 for a third embodiment, where the wheel spindle 52 is provided at an extreme end thereof with a pair of cutout parallel surfaces which fits in a complementary hole formed in each of the core members 14, an imaginary line which extends across the axis or center of the complementary hole in parallel with a pair of parallel internal surfaces 54 of the complementary hole may be taken as the reference position SP. In this embodiment, one of the paired grinding wheels 50 is attached to bring one end of one of the inclined grooves 20 thereon into alignment with the imaginary line, while the other grinding wheel 60 is attached to bring one end of one of the inclined grooves 20 thereon to an angular position which is offset by a predetermined angular phase from the imaginary line.

Moreover, in the foregoing embodiments, the two grinding wheels 10, 10 (50, 60) are attached to one end of the single wheel spindle 32 (52). However, the present invention is not limited to the configuration. The number of these grinding wheels attached to the single wheel spindle 32 (52) may be, for example, three or four. Where so modified, it can be realized for example to simultaneously grind journal sections on a crank shaft efficiently and accurately.

Various features and many of the attendant advantages in the foregoing embodiments will be summarized as follows:

In the foregoing first embodiment typically shown in FIGS. 2 to 5, since the inclined grooves 20 formed on one grinding wheel 10 and those 20 formed on another grinding wheel 10 are shifted through different angular distances (A, A') relative to the reference position SP defined on the core member 14 of each grinding wheel 10 not to coincide between the grinding wheels 10, the fluctuations in the dynamic pressures and the grinding resistances on the respective grinding wheels 10 can be mitigated not to grow as a combined or synergy effect through synchronization between these grinding wheels 10. As a consequence, the fluctuation in the grinding resistance is reduced in the direction normal to the grinding surface 15, so that it can be realized to enhance the machining accuracy of the workpiece W.

Also in the foregoing first embodiment typically shown in FIG. 7, since at least one inclined groove 20 continually passes across the grinding point P in the vertical direction even in any rotational phase of the grinding wheel 10, coolant supplied to the grinding point P between each grinding wheel 10 and the workpiece portion CW ground therewith is discharged without generating a dynamic pressure, so that the machining accuracy of the workpiece portion CW can be further enhanced.

Figure 8:
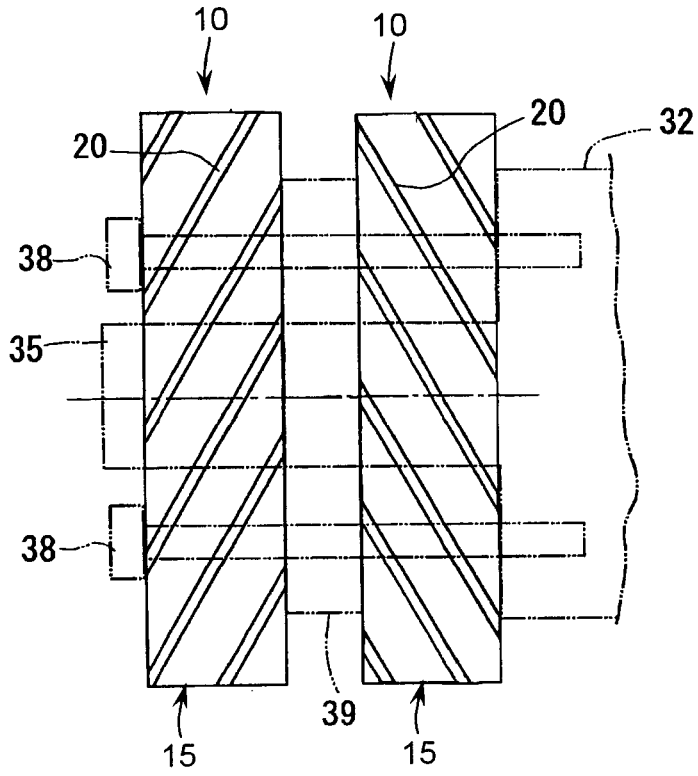
FIG. 8 is a fragmentary view of a wheel spindle device in a second embodiment according to the present invention.

In the foregoing second embodiment typically shown in FIG. 8, since the grinding wheels attached to the wheel spindle 32 comprises two grinding wheels 10 which are opposite to each other in the inclination directions of the inclined grooves 20 formed thereon, the axial force generated by the inclined grooves 20 on one grinding wheel 10 in one axial direction can be cancelled with the axial force generated by the inclined grooves 20 on the other grinding wheel 10 in the other axial direction, so that the machining accuracy of the workpiece portions CW can be further enhanced.

In the foregoing third embodiment shown in FIGS. 9 and 10, since the reference position SP is defined by the rotation restriction portion 54 such as, e.g., a bolt hole, a keyway, or the like which is provided on each of the grinding wheels 50, 60 to restrict the rotation of each the grinding wheel 50, 60 relative to the wheel spindle 52, the grinding wheels 50, 60 can be easily attached to the wheel spindle 52 with the inclined grooves 20 on each grinding wheel 50 being offset in angular phase from those on another grinding wheel 60, and the attachments of the grinding wheels 50, 60 to the wheel spindle 52 can be done easily by the utilization of an existing feature portion on each grinding wheel 50, 60 without using any specified mark.

In the modified form of the foregoing first embodiment shown in FIGS. 3 and 4, the grinding wheels 10 are individually attached to the balancing machine with the inclined grooves 20 on each grinding wheel 10 being offset in angular phase from those on another grinding wheel 10 and is individually adjusted for correct balance, and the attaching mark 40 which indicates the reference position SP for the attachment to the balancing machine is put as the reference position SP on each grinding wheel 10 (so that the attaching mark 40 is oriented to, e.g., the top position on a rotational locus thereof when the plurality of grinding wheels 10 are individually attached to the wheel spindle 32). Therefore, in attaching the plurality of grinding wheels 10 to the wheel spindle 32, the attaching work which is to be done with the inclined grooves 20 on each grinding wheel 10 being offset in angular phase from those on another grinding wheel 10 can be done very easily, so that the efficiency in the attaching work can be enhanced greatly.

Obviously, numerous further modifications and variations of the present invention are possible in light of the above teachings. It is therefore to be understood that within the scope of the appended claims, the present invention may be practiced otherwise than as specifically described herein.

What is claimed is:

1. A wheel spindle device for a grinding machine, comprising:

a wheel head of the grinding machine;

a wheel spindle rotatably carried on the wheel head; and a plurality of grinding wheels attached to the wheel spindle and each composed of a core member attached to the wheel spindle and a grinding layer provided on the circumferential surface of the core member and having numerous abrasive grains bonded with a bonding material, wherein:

a reference position for specifying a position in the circumferential direction is defined on each of the core members;

a plurality of inclined grooves which are inclined relative to the circumferential direction of each grinding wheel are formed at predetermined angular intervals on the circumferential surface of the grinding layer on the basis of the reference position; and the inclined grooves formed on the grinding layer of each grinding wheel are shifted in angular phase from said reference position by a different angular distance as compared to the inclined grooves formed on the grinding layer of another grinding wheel.

2. The wheel spindle device as set forth in claim 1, wherein the predetermined angular intervals of the inclined grooves formed on each of the grinding wheels are determined so that at least one inclined groove continually passes across a grinding point between each grinding wheel and a workpiece portion ground therewith during a grinding operation.

3. The wheel spindle device as set forth in claim 1, wherein the reference position is defined by a rotation restriction portion which is provided on each of the grinding wheels to restrict the rotation of each grinding wheel relative to the wheel spindle.

4. The wheel spindle device as set forth in claim 1, wherein the reference position provided on each grinding wheel is defined by an attaching mark which indicates a reference position for attaching the grinding wheel after balance adjustment to the wheel spindle.

5. The wheel spindle device as set forth in claim 1, wherein the grinding wheels attached to the wheel spindle comprises two grinding wheels which are opposite to each other in the inclination directions of the inclined grooves formed thereon.

6. The wheel spindle device as set forth in claim 1, wherein:

the inclined grooves formed on one of the grinding wheels are the same as the inclined grooves formed on another grinding wheel in inclination angle, angular intervals and in shape; and the inclined grooves formed on one of the grinding wheels are angularly offset from the inclined grooves formed on another grinding wheel by about the half of the angular interval between the inclined grooves.

* * * * *